US006526600B1

(12) United States Patent
Hernandez

(10) Patent No.: US 6,526,600 B1
(45) Date of Patent: Mar. 4, 2003

(54) TOILET LID POSITION CONTROL

(76) Inventor: Roland Hernandez, 1044 Balsa Cir., La Verne, CA (US) 91750

( * ) Notice: Subject to any disclaimer, the term of this patent is extended or adjusted under 35 U.S.C. 154(b) by 0 days.

(21) Appl. No.: 10/131,558

(22) Filed: Apr. 22, 2002

(51) Int. Cl.[7] ..... A47K 13/10
(52) U.S. Cl. ..... 4/246.1
(58) Field of Search ..... 4/246.1, 246.2, 4/250

(56) References Cited

U.S. PATENT DOCUMENTS

| | | | | | |
|---|---|---|---|---|---|
| 1,907,826 | A | | 5/1933 | Kapp | |
| 3,579,664 | A | * | 5/1971 | Johnson | 4/250 |
| 5,058,216 | A | | 10/1991 | Trayer et al. | |
| 5,177,818 | A | | 1/1993 | Tsai | |
| 5,222,260 | A | | 6/1993 | Piper | |
| 5,289,593 | A | | 3/1994 | Lawrence | |
| 5,430,897 | A | * | 7/1995 | Lavender | 4/246.1 |
| 5,592,700 | A | * | 1/1997 | Genesse | 4/246.1 |
| 5,689,838 | A | * | 11/1997 | MacKenzie | 4/246.1 |
| 5,754,985 | A | | 5/1998 | Dias | |
| 5,774,904 | A | * | 7/1998 | McWilliams | 4/246.2 |
| 5,781,938 | A | | 7/1998 | Anderson | |
| 5,867,843 | A | | 2/1999 | Robello et al. | |
| 6,240,751 | B1 | | 6/2001 | Mayyak | |
| 6,438,764 | B1 | * | 8/2002 | Andersen | 4/246.1 |

* cited by examiner

*Primary Examiner*—Charles R. Eloshway
(74) *Attorney, Agent, or Firm*—William W. Haefliger

(57) ABSTRACT

Apparatus to displace a raised toilet seat or cover member, comprising, in combination a carrier to be supported on a toilet water tank, structure pivotally supported on that carrier, a pusher associated with said structure positioned to displace said member as the structure pivots, and an actuator associated with said structure and positioned to pivot said structure in response to lowering of the surface level of water in the tank.

10 Claims, 2 Drawing Sheets

TOILET LID POSITION CONTROL

BACKGROUND OF THE INVENTION

This invention relates generally to operation of flush toilets, and more particularly to a device to automatically manipulate a toilet lid.

There is long standing need to assure that raised toilet lids are closed after flush toilet use. There is also need for a very simple inexpensive and rugged device that will fulfill this need.

SUMMARY OF THE INVENTION

It is a major object of the invention to provide such a needed device or apparatus to manipulate and automatically close a toilet lid, in response to lowering of the water level in the toilet tank, as during toilet flushing after toilet use. Basically, the apparatus of the invention comprises:

a) a carrier to be supported on a toilet water tank, b) structure pivotally supported on that carrier, c) a pusher associated with said structure positioned to displace said member as the structure pivots, and d) an actuator associated with said structure and positioned to pivot said structure in response to lowering of the surface level of water in the tank.

Another object of the invention is to provide the carrier in a form configured to fit onto an upper rim portion of the tank. Typically, the carrier may have simple channel shape, to be retained in position by the toilet tank top.

A further object includes provision of the pivoting structure to include a rod that projects crosswise of the channel and has bends to orient rod segments to function as referred to.

An additional object is to locate the pusher between the tank and an upper portion of the raised toilet seat.

As will appear, the pusher may be formed by bent rod segments, sized to be covered by decorative fabric or other attachment.

These and other objects and advantages of the invention, as well as the details of an illustrative embodiment, will be more fully understood from the following specification and drawings, in which:

DRAWING DESCRIPTION

DETAILED DESCRIPTION

Figure 1:
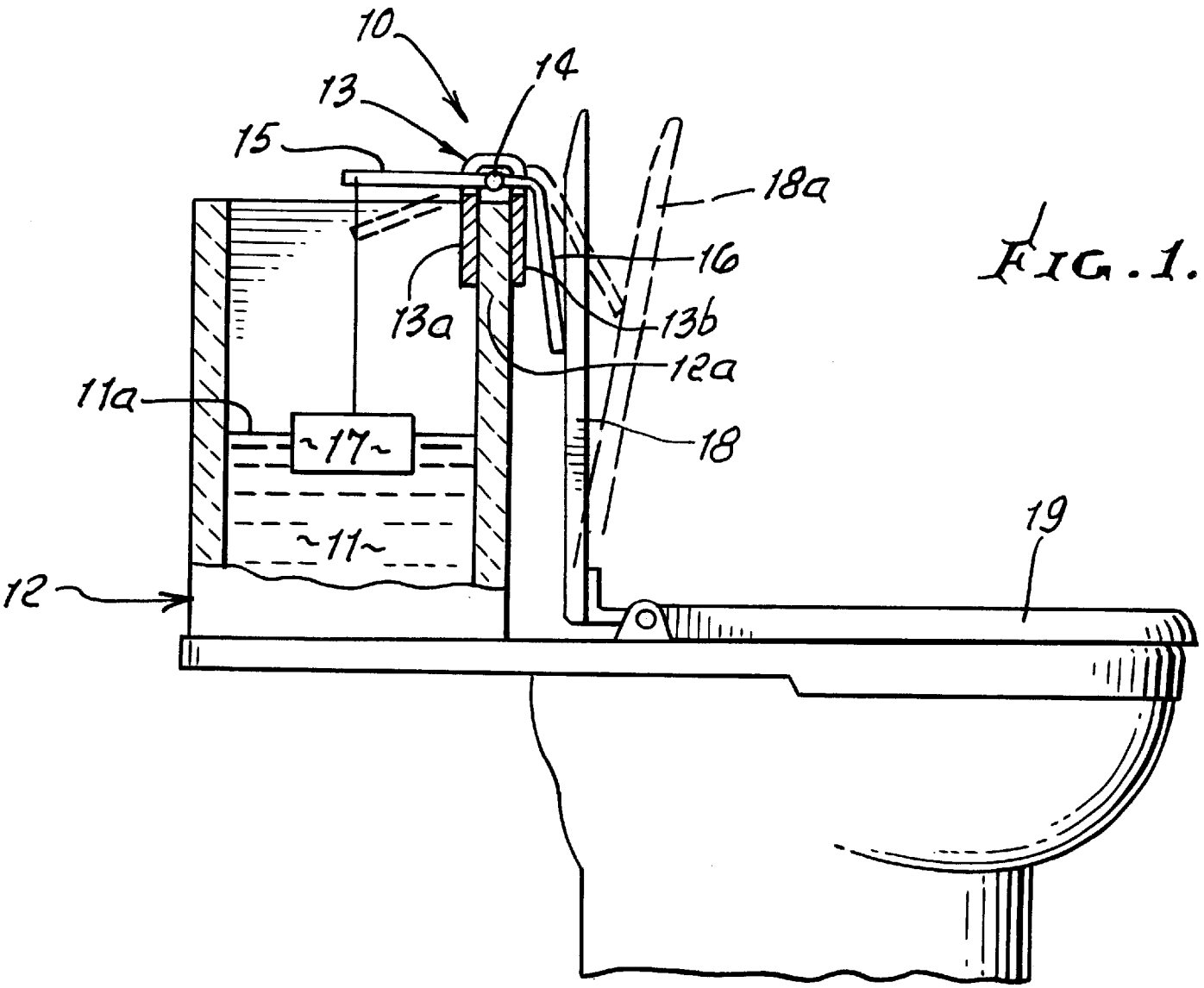
FIG. 1 is a side elevation showing basic features of the invention.

Referring first to FIG. 1, it shows the basic features of the invention. As shown, the device or apparatus 10 manipulates the position of a toilet lid in response to lowering of the level 11*a* of water 11 in a toilet flush water tank 12.

As shown, the device 10 includes a mounting or carrier channel 13, with plates 13*a* and 13*b*, that fits down over the top wall section 12*a* of the tank 12. The channel 13 carries structure including pivot 14 for arms 15 and 16 extending in generally L-shape or as bell crank. Arm 15 suspends a weight 17 that floats in tank flush water 11. Arm 16 extends generally downwardly or adjacent a toilet lid 18 and defines a pusher. As the water level 11*a* drops, the actuator weight 17 also drops, pivoting arms 15 and 16 counterclockwise, so that arm 16 pushes lid 18 clockwise in a downwardly closing direction, i.e. toward seat 19. See moving lid position 18*a* in broken lines.

As an alternate, arm 16 may extend at the front side of the lid, to retain it in up position until the water in the tank drops, causing arm 16 pivoting away from the lid, and allowing lid closing. Arms 15 and 16 may comprise have wire or rod.

Figure 2:
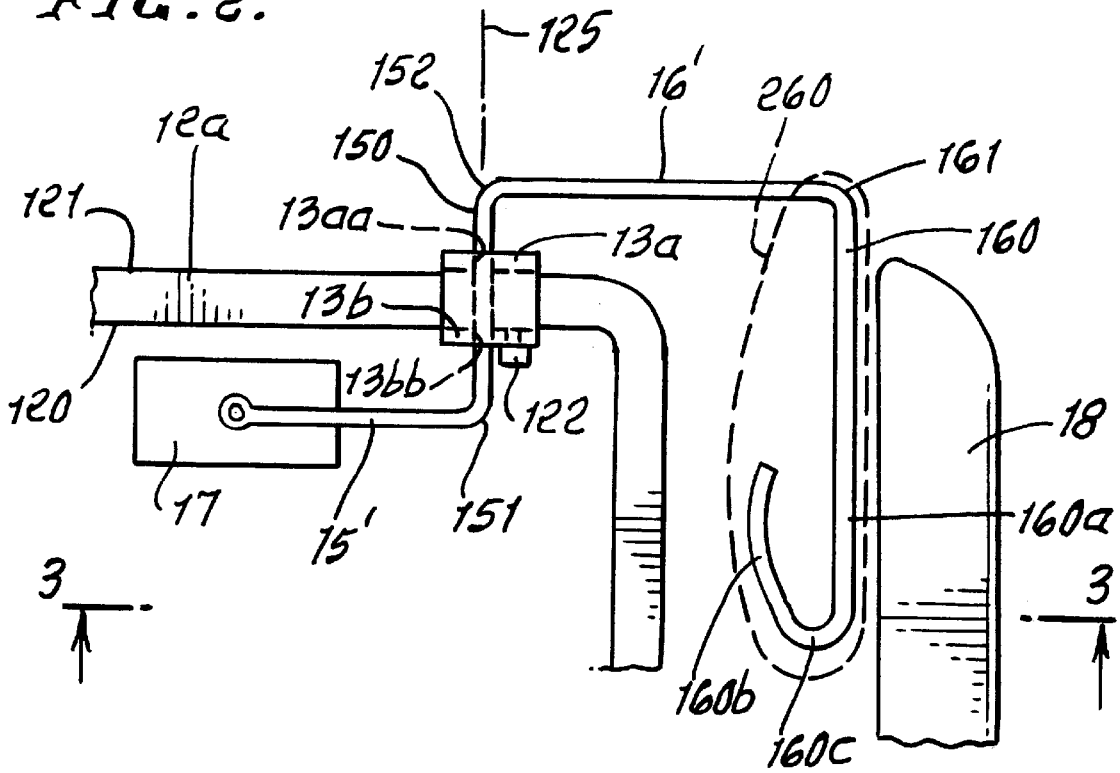
FIG. 2 is an enlarged, fragmentary, top plan view showing an improved pivoted arm construction conforming to a toilet tank.

In FIG. 2, the highly advantageous and preferred arms 15' and 16', corresponding to arms 15 and 16, are interconnected by arm segment 150, and the entirety of 15', 150, and 16' may be defined by a heavy duty wire or rod, having bends at 151, 152, and 161. Note that right angle bend 151 interconnects 15' and 150; right angle bend 152 interconnects 150 and 16'; and right angle bend 161 interconnects 16' and rod end portion 160 defining a pusher to push lid 18, as referred to.

Rod segment 150 defines a pivot axis 125 and extends through holes 13*aa* and 13*bb* in upper extents of the channel plates 13*a* and 13*b*, which define a pivot bearing. Segment 150 closely extends over the top 12*a'* of toilet tank wall 12*a*, and is protected by the channel web 3*c* interconnecting plates 13*a* and 13*b* and extending over the pivot segment 150. Plates 13*a* and 13*b* fit adjacent inner and outer sides 120 and 121 of wall section 12*a*; and a tightener 122 may be provided as shown to provide clamping retention force, clamping the channel to wall section 12*a*, if needed.

Arm segment or section 15' extends generally perpendicular to the pivot axis 125 and is angled downwardly in the tank, so that its end 15*a'* suspending weight 17 via strand 17*a* moves down, in the tank, as water level 11*a* drops. Accordingly, arm section 15' extends generally parallel to the upright plane of wall section 12*a*.

Figure 3:
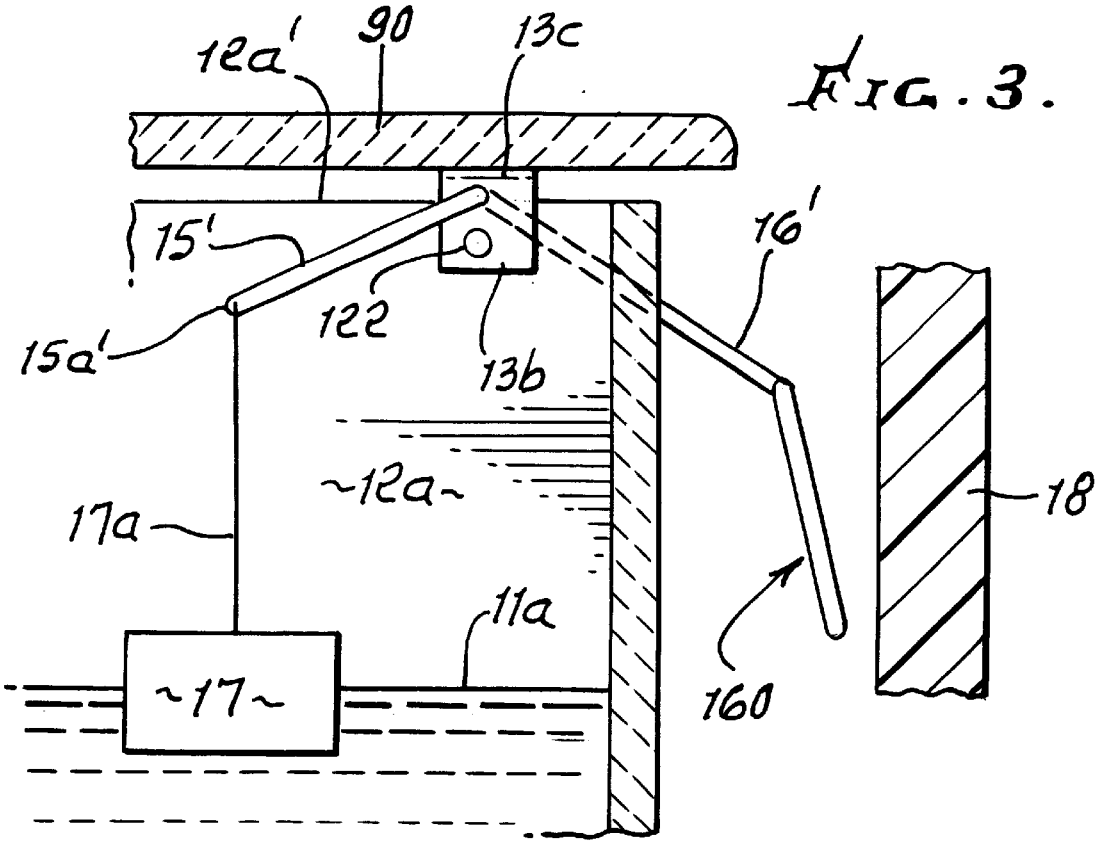
FIG. 3 is an elevation taken on lines 3—3 of FIG. 2.

Arm section 16' extends outside the tank and is angled downwardly as seen in FIG. 3, so that as the weight lowers, pusher 160 pushes toward and against the raised lid 18, moving it forwardly and downwardly, the lower end of 18 being pivotally supported as is conventional. Pusher 160 may include wire or rod segments 160*a* and 160*b* connected by a bend 160*c*, and forming a paddle to engage the lid. Numeral 260 indicates decorative fabric that may be slipped over the paddle rod, to conceal that rod.

FIG. 3 also shows the toilet tank top or lid 90 seating downwardly on the channel 13, retaining it in position, if needed.

The invention is also applicable to locating the pusher between a raised toilet seat, and the tank or lid, to effect lowering of the seat, as during flushing.

Accordingly, a highly useful, very simple, inexpensive and rugged device is provided to manipulate and automatically close lid 18, as the water level in the tank lowers, during toilet flushing, after toilet use. It can easily be removed for storage, and replaced when needed.

I claim:

1. Apparatus to displace a raised toilet seat or cover member, comprising, in combination:

a) a carrier to be supported on a toilet water tank, b) structure pivotally supported on that carrier, c) a pusher associated with said structure positioned to displace said member as the structure pivots, and d) an actuator including a weight associated with said structure and positioned to pivot said structure in response to lowering of the surface level of water in the tank, e) the carrier being configured to fit onto an upper rim portion of the tank, and having the form of a channel, f) the tank having a top seating downwardly on the channel, g) said structure including an elongated rod to project over said weight, and to project to said pusher.

2. The combination of claim 1 wherein said structure projects crosswise of said channel to define a pivot.

3. The combination of claim 2 wherein said structure includes a rod portion that projects crosswise of said channel to form the pivot.

4. The combination of claim 2 wherein said pusher includes an extension of said rod portion.

5. The combination of claim 1 wherein said tank has a wall facing said raised toilet seat, said pusher extending between said tank wall and said seat.

6. The combination of claim 5 wherein said pusher includes a rod forming a bend carrying a decorative attachment.

7. The combination of claim 1 wherein the weight is suspended to float in the water in said tank.

8. Apparatus to displace a raised toilet seat or cover member, comprising, in combination:

a) a carrier to be supported on a toilet water tank, b) structure pivotally supported on that carrier, c) a pusher associated with said structure positioned to displace said member as the structure pivots, and d) an actuator including a weight associated with said structure and positioned to pivot said structure in response to lowering of the surface level of water in the tank, e) said carrier having the form of a channel and being configured to fit onto an upper rim portion of the tank, f) said structure projecting crosswise of said channel to define a pivot, g) and including said tank rim portion, said pivot located directly above said rim portion.

9. The combination of claim 8 wherein said structure includes an elongated rod that projects to said pusher.

10. Apparatus to displace a raised toilet seat or cover member; comprising, in combination:

a) a carrier to be supported on a toilet water tank, b) structure pivotally supported on that carrier, c) a pusher associated with said structure positioned to displace said member as the structure pivots, and d) an actuator including a weight associated with said structure and positioned to pivot said structure in response to lowering of the surface level of water in the tank, e) said structure including an elongated rod to project over said weight, and said structure projecting to said pusher.

* * * * *